United States Patent [19]

Wilson

[11] 4,109,906

[45] Aug. 29, 1978

[54] SKIP ROPE

[76] Inventor: Bradford W. Wilson, 1642-A Coriander, Costa Mesa, Calif. 90626

[21] Appl. No.: 649,471

[22] Filed: Jan. 15, 1976

[51] Int. Cl.[2] ..... A63B 5/20; A63B 21/02

[52] U.S. Cl. ..... 272/75; 272/142

[58] Field of Search ..... 272/75, 74, 135, 116, 272/125, 126, 133, 140, 142, 143, DIG. 4, 136, 137, 138, 139; 46/1 G, 47

[56] References Cited

U.S. PATENT DOCUMENTS

| | | | |
|---|---|---|---|
| 85,514 | 1/1869 | Cross | 272/75 |
| 98,928 | 1/1870 | Coon | 272/75 |
| 623,698 | 4/1899 | Beckh | 272/75 |
| 664,210 | 12/1900 | Bryon, Jr. | 272/136 |
| 763,475 | 6/1904 | Frazee et al. | 272/136 |
| 2,942,881 | 6/1960 | Recalma | 272/75 |

FOREIGN PATENT DOCUMENTS

| | | | |
|---|---|---|---|
| 519,580 | 12/1955 | Canada | 272/75 |
| 816,571 | 7/1969 | Canada | 272/74 |
| 605,358 | 2/1926 | France | 272/75 |
| 409,167 | 2/1910 | France | 272/136 |
| 400,283 | 5/1909 | France | 272/142 |
| 5,567 of | 1890 | United Kingdom | 272/75 |
| 559 of | 1902 | United Kingdom | 272/75 |
| 16,447 of | 1911 | United Kingdom | 272/75 |

*Primary Examiner*—Richard C. Pinkham
*Assistant Examiner*—Arnold W. Kramer
*Attorney, Agent, or Firm*—Gordon L. Peterson

[57] ABSTRACT

A skip rope comprising first and second end sections and a resilient central section removably coupled to the end sections. The central section is heavier per unit of length than either of the end sections and is also less flexible. A plurality of the central sections having different characteristics are provided.

7 Claims, 6 Drawing Figures

SKIP ROPE

BACKGROUND OF THE INVENTION

Skipping rope is a common activity among athletes, children and those wishing to achieve or maintain some degree of physical fitness. As is well know, a skip rope forms a U-shaped configuration when it is being used for skipping.

Various attempts have been made to make rope skipping easier to learn and to make it a more strenuous exercise. For example, it is known to place a tube over the central section of a skip rope. This adds to the weight of the skip rope to make use of the rope more strenuous. Because the tube makes the skip rope heavier, it is more readily thrown outwardly by centrifugal force and tends to get beneath the feet of the user. Finally, the tube, which is relatively stiff, assures that the bottom of the U will be sufficiently wide for the user. Similar results are obtained by another prior art skip rope which has an integral central region of increased thickness.

One problem with these prior art skip ropes is that they lack versatility. Thus, the physical characteristics of these skip ropes are substantially not alterable. For example, the weight and stiffness of these prior art ropes cannot be varied to meet the changing needs of the user.

SUMMARY OF THE INVENTION

The present invention allows the jumper to vary the physical characteristics of the skip rope in accordance with his changing requirements. For example, with this invention the user can control how strenuous the rope skipping exercise will be.

The skip rope of this invention includes an elongated flexible member which comprises first and second end sections and a central section intermediate the end sections. When the rope is used for skipping, it assumes a U-shaped configuration with the end sections forming the sides of the U respectively and with the central section forming an arcuate bottom for the U. To permit the user to control the characteristics of the rope and of the exercise obtained therefrom, the present invention provides for releasably connecting the central section to the two end sections. This permits the central section to be replaced with another central section of a different weight, stiffness, or other characteristic in accordance with the needs and desires of the user.

Appropriate fastener means may be used for releasably connecting the central section to the two end sections. These fastener means may be used to advantage to widen the bottom of the arc if they are made of greater density than the side sections. The added weight provided by the fastener means increases the centrifugal force on the side sections and tends to pull them relatively straight outwardly from the hands of the user with the result that the bottom of the arc tends to widen.

The bottom of the arc can also be widened by making the central section less flexible than either of the side sections. The added stiffness of the central section tends to maintain the bottom of the U in a relatively wide arc as the rope is being used for skipping. The relatively wide arcuate bottom of the U further reduces the likelihood of tripping.

The present invention permits the user to select a central section having a weight corresponding to the amount of energy which the user desires to expend.

Preferably the central section is heavier per unit of length than the side sections. If the central section is relatively heavy, it is more readily thrown outwardly by centrifugal force and tends to get beneath the user's feet more easily. Thus, the likelihood of the user tripping on the rope is materially reduced.

The versatility of the skip rope of this invention is enhanced by making at least a portion of at least one of the sections resilient in the axial direction. This enables the rope, or at least the resilient portion, to be used for other exercises. Preferably, the central section is resilient so that it may be used for other exercises, both as a part of the skip rope, and when it is detached from the remainder of the skip rope.

The invention, together with further features and advantages thereof, may best be understood by reference to the following description taken in connection with the accompanying illustrative drawing.

DESCRIPTION OF THE PREFERRED EMBODIMENT

Figure 1:
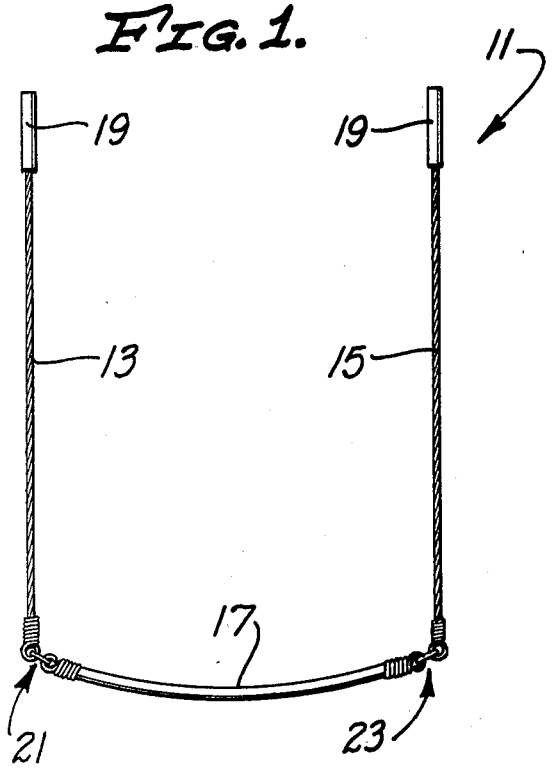
FIG. 1 is a front elevational view of a skip rope constructed in accordance with the teachings of this invention.

FIG. 1 shows a skip rope 11 which includes end sections 13 and 15, a central section 17, handles 19, and fastener means 21 and 23 for releasably coupling the end sections to the central section. The end sections 13 and 15 and the central section 17 form an elongated flexible member.

Each of the end sections 13 and 15 is formed of an elongated flexible element such as a rope. The end sections 13 and 15 are of equal length and may be identical. Each of the end sections 13 and 15 has an outer end to which the handles 19 are attached, respectively. The handles 19 may be of any suitable construction and may, if desired, include ball bearings. In the embodiment illustrated, each of the handles 19 is identical and is constructed of wood.

Each of the end sections 13 and 15 has an inner end which is joined to an adjacent end of the central section by the fastener means 21 and 23. The central section 17 is an elongated flexible element. In the embodiment illustrated, the central section is heavier per unit of length than either of the end sections 13 and 15. The central section 17 may be made heavier per unit of length than the end sections 13 and 15 in various ways such as by making the central section of high density material and/or of greater cross sectional area. Alternatively, or in addition thereto, the central section 17 could be weighted by attaching or embedding weights therein. In the embodiment illustrated, the central section 17 is constructed of material of greater density than the end sections 13 and 15, and the central section is of larger cross sectional area than either of the end sections.

The central section 17 is also less flexible, i.e. stiffer in the axial direction than either of the end sections 13 and 15. The central section 17 may be made less flexible than the end sections 13 and 15 in various ways such as by utilizing stiffer material for the central section 17 or by employing members which will longitudinally stiffen the central section. Alternatively, or in addition thereto, the cross section of the central section 17 may be sized and/or configured for added stiffness against bending. In the embodiment illustrated, the material of the central section 17 and the increased cross sectional area of the central section 17 make it less flexible than the end sections 13 and 15.

In the embodiment illustrated, the central section 17 is constructed of a resilient material such as rubber. The rubber of the central section 17 can be provided with the desired stiffness and density characteristics to give the central section the desired weight per unit of length and stiffness. In addition, the rubber makes the central section 17 resilient along its longitudinal axis with the result that the skip rope 11 can be used for other exercises.

When the skip rope is used for its intended purpose, it will assume a generally U-shaped configuration similar to the configuration shown in FIG. 1. In this position, the end sections 13 and 15 form the sides of the U, and the central section forms an arcuate bottom of the U. It is desirable that the sections 13, 15 and 17 of sufficient length to accomplish this purpose. Preferably, the end sections 13 and 15 are of equal length, and the central section may have a length which ranges from shorter than the end sections to longer than the end sections. By way of example, and not by way of limitation, each of the end sections 13 and 15 may be about three feet long and the central section 17 may be from two feet to four feet in length.

Figure 4:
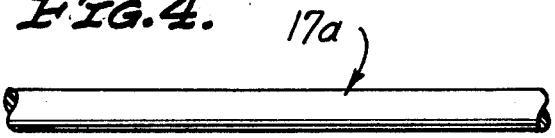
FIGS. 4–6 are fragmentary elevational views of different kinds of central sections which may be used in the skip rope of FIG. 1.
Figure 5:
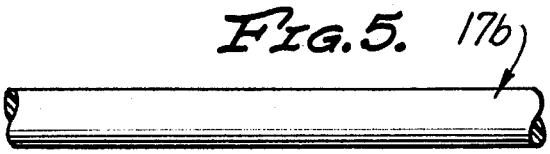
Figure 6:
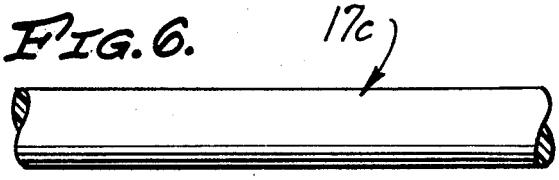

Certain advantages are obtained by releasably interconnecting the sections 13, 15 and 17 with the fastener means 21. One advantage of the releasable fastener means is that the central section 17 may be replaced by another central section such as any of the central sections 17*a*, 17*b* or 17*c* (FIGS. 4—6). The central sections 17*a*, 17*b* and 17*c* have one or more characteristics such as weight, stiffness, or resilience which is different from the central section 17. In the embodiment illustrated, the central sections 17*a*–17*c* are resilient and of progressively increasing weight and cross sectional area. Thus, more rigorous and concentrated exercise may be obtained with the central section 17*c* than with the central section 17. In addition, with the central section 17 removed from the end sections 13 and 15, it can be used separately as a resilient exercising device.

Another advantage is obtainable from the fastener means 21 and 23 if they are of greater density than the end sections 13 and 15. The added weight at the inner ends of the end sections 13 and 15 creates additional centrifugal force at the inner ends of the end sections 13 and 15 which in turn tends to keep the inner ends widely spaced, i.e. it tends to widen the bottom of the U during use.

The fastener means 21 and 23 may be of any construction which will releasably attach the central section 17 to the end sections 13 and 15. It is desirable, although certainly not essential, that the fastener means 21 and 23 be quickly and easily operable to connect and disconnect the central section 17 from the end sections 13 and 15.

Figure 2:
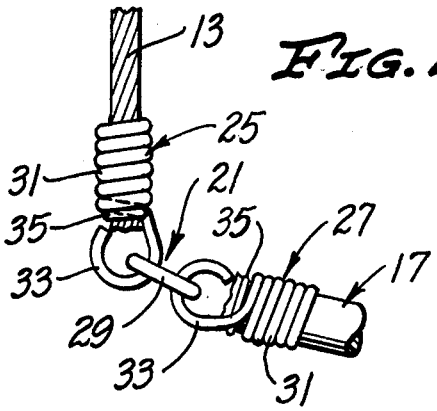
FIG. 2 is an enlarged fragmentary elevational view showing one way in which the adjacent ends of the central section and one of the side sections may be joined.
Figure 3:
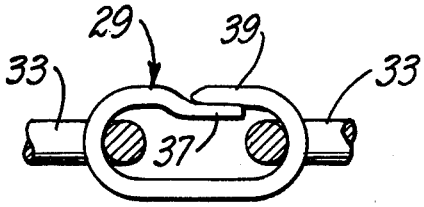
FIG. 3 is a fragmentary elevational view of one form of releasable fastener for interconnecting the sections of the skip rope.

FIGS. 2 and 3 show one form that the fastener means 21 and 23 may take. It should be understood that the construction shown in FIGS. 2 and 3 is merely illustrative and that the fastener means 21 and 23 may take other forms.

As the fastener means 21 and 23 are identical, only the fastener means 21 is shown in detail in FIGS. 2 and 3. The fastener means 21 includes identical adapters 25 and 27 mounted on the inner end of the end section 13 and the adjacent end of the central section 17 and a releasable fastener 29. Each of the adapters 25 and 27 is identical, and in the embodiment illustrated is formed from relatively stiff wire. Each of the adapters 25 and 27 includes a coil 31 and a hook 33. The coils 31 form tubes which receive the end portions of the end sections 13 and the central section 17, respectively. Annular retainers 35 hold the coils on the sections 13 and 17.

Although the fastener 29 may take many different forms, in the embodiment illustrated, it is constructed of a single piece of resilient metal bent into a loop and having overlapping end portions 37 and 39. To open the fastener 29, the end portion 37 is forced inwardly against the resilience of the fastener to allow removal of one or both of the hooks 33.

The skip rope 11 can be used in a manner conventional for skip ropes. When so used, the relatively heavy central section 17 tends to get the central section beneath the feet of the user. Because the central section 17 is relatively stiff, the bottom of the U-shaped arc is widened to further facilitate jumping. Because the central section 17 is resilient, it can be used individually, or as a part of the skip rope 11, or for other exercises. Finally, the fastener means 21 and 23 enable the user to select a central section 17–17*c* of the desired weight and stiffness.

Although exemplary embodiments of this invention have been shown and described, many changes, modifications and substitutions may be made by those with ordinary skill in the art without necessarily departing from the spirit and scope of this invention.

I claim:

1. A skip rope comprising:

an elongated flexible member;

said elongated flexible member including first and second flexible end sections and a flexible first central section intermediate the first and second end sections whereby when the elongated flexible member is put in a generally U-shaped configuration for skipping the first and second end sections form at least substantial segments of the sides of the U and the first central section forms at least a substantial segment of the bottom of the U;

each of said end sections having an outer end and an inner end;

first and second handles coupled respectively to the outer ends of the first and second end sections;

a second flexible central section having at least one characteristic which is different from said first central section;

means releasably connecting the inner ends of the first and second end sections to the opposite ends, respectively, of the first central section whereby the first central section can be replaced with the second central section;

at least a portion of the first central section being resilient in the axial direction whereby the first central section can be used for exercises other than skipping rope; and said first central section being heavier per unit of length than either of said first and second end sections whereby when the elongated flexible member is put in the U-shaped configuration and swung the relatively heavy bottom of the U tends to get beneath the feet of the user, said end sections being of a different material than said first central section.

2. A skip rope as defined in claim 1 wherein said releasably connecting means is of greater density than any of said end sections.

3. A skip rope as defined in claim 1 wherein said first central section is less flexible than any of said end sections and tends to maintain the bottom of the U in a relatively wide arc.

4. A skip rope as defined in claim 3 wherein said releasably connecting means is of greater density than any of said end sections and said first central section is constructed of rubber and each of said end sections is constructed of rope.

5. A skip rope as defined in claim 1 wherein said first central section is less flexible than any of said end sections.

6. A skip rope as defined in claim 1 wherein said first central section is constructed of rubber and each of said end sections is constructed of rope.

7. A skip rope is defined in claim 1 wherein said releasably connecting means includes first and second fastener means releasably attaching said inner ends of the first and second end sections to the opposite ends, respectively, of the first central section, and said first central section is less flexible than either of said end sections.

* * * * *